US006195514B1

(12) United States Patent
Kim

(10) Patent No.: US 6,195,514 B1
(45) Date of Patent: Feb. 27, 2001

(54) LIQUID IMAGE FORMING APPARATUS AND METHOD THEREOF

(75) Inventor: Yong-kook Kim, Seongnam (KR)

(73) Assignee: Samsung Electronics Co. Ltd., Kyungki-Do (KR)

( * ) Notice: Subject to any disclaimer, the term of this patent is extended or adjusted under 35 U.S.C. 154(b) by 0 days.

(21) Appl. No.: 09/471,336

(22) Filed: Dec. 23, 1999

(30) Foreign Application Priority Data

Jan. 7, 1999 (KR) ..... 99-159

(51) Int. Cl.[7] ..... G03G 15/00; G03G 15/11

(52) U.S. Cl. ..... 399/43; 399/36; 399/237; 399/251; 430/117

(58) Field of Search ..... 399/251, 237, 399/57, 43, 167, 36; 430/117

(56) References Cited

U.S. PATENT DOCUMENTS 4,500,957 * 2/1985 Hanamoto et al. ..... 399/36
5,519,478 * 5/1996 Malachowski ..... 399/8
5,999,775 * 12/1999 Kim ..... 399/251 X

* cited by examiner

*Primary Examiner*—Sophia S. Chen
(74) *Attorney, Agent, or Firm*—Sughrue, Mion, Zinn, Macpeak & Seas, PLLC

(57) ABSTRACT

A liquid image forming apparatus includes a rotation speed detection portion provided at one side of the image drying roller for detecting a rotation speed of said image drying roller. A speed comparison portion determines whether the image drying roller is rotating at normal speed by comparing the rotation speed of the image drying roller, detected by the rotation speed detection portion, with a predetermined range of a reference rotation speed. A controlling portion makes the heating roller heat the image drying roller to a reference temperature to vaporize the liquid carrier absorbed by the image drying roller, when it is determined from a signal from the speed comparison portion that the image drying roller does not maintain the regular speed. Thus, the toner image in a damp state, which is vulnerable to damage due to friction before being dried, can be protected and a quality printed material can be obtained.

9 Claims, 5 Drawing Sheets

LIQUID IMAGE FORMING APPARATUS AND METHOD THEREOF

BACKGROUND OF THE INVENTION

1. Field of the Invention

The present invention relates to a liquid image forming apparatus and a method thereof, and more particularly, to a liquid image forming apparatus which can reduce deformation of an image film formed on a photoreceptor web, and a method thereof.

2. Description of the Related Art

An image forming apparatus is divided into a liquid type and a dry type according to the type of developer used. The liquid image forming apparatus uses developer in which toner in a powder state is distributed in a volatile liquid carrier. In the liquid imaging system, an electrostatic latent image is formed by emitting a laser beam onto a photoreceptor web or organic photoreceptor (OPR) circulating along an endless path. Liquid toner is supplied to develop the electrostatic latent image into a toner image and the toner image is transferred to a printing paper.

FIG. 1 shows the structure of a conventional imaging system. Referring to FIG. 1, a photoreceptor web 110 is supported by a backup roller 111, a steering roller 112, and a driving roller 113. The backup roller 111 presses the photoreceptor web 110 to provide a predetermined pressure to the transfer roller 114 installed adjacent thereto to transfer a toner image in a film state formed on the photoreceptor web to the transfer roller 114. A press roller 115 in contact with the transfer roller 114 at a predetermined pressure is installed at one side of the transfer roller 114 to transfer the toner image adhering to the transfer roller 114 to a print paper 116 passing between the transfer roller 114 and the press roller 115.

An image forming apparatus 200 for forming the toner image on a surface of the photoreceptor web 110 is disposed along the photoreceptor web 110 between the steering roller 112 and the driving roller 113. The image forming apparatus 200 includes laser scanning units (LSU's) 202*a*, 202*b*, 202*c*, and 202*d*, using a laser beam and developing units 201*a*, 201*b*, 201*c*, and 201*d*, which are alternately installed. For each color, that is, yellow, magenta, cyan and black, a laser scanning unit and a developing unit adjacent thereto form a toner image unit.

The laser scanning units 202*a*, 202*b*, 202*c*, and 202*d*, emit a laser beam onto the surface of the photoreceptor web 110 according to an image signal per color to form an electrostatic latent image. The developing units 201*a*, 201*b*, 201*c*, and 201*d*, develops the latent image formed by the laser scanning units to a toner image.

The developing units 201*a*, 201*b*, 201*c*, and 201*d*, of the image forming apparatus 200 each include a developing roller for coating a developer of a predetermined color on the photoreceptor web 110, and a squeeze roller for removing excess developer coated on the photoreceptor web 110.

An image drying roller 120 for removing liquid carrier remaining on the toner image from the photoreceptor web 110 is provided to be adjacent to the driving roller 113. The surface of the image drying roller 120 consists of an outer surface having an affinity for oil for absorbing the liquid carrier from the photoreceptor web 110 and an inner surface disposed under the outer surface and having an anti-oil characteristic for preventing intrusion of the liquid carrier. The image drying roller 120 absorbs the liquid carrier remaining on the surface of the photoreceptor web 110 while being rotated in contact with the photoreceptor web 110. Two heating rollers 121 and 122 separated a predetermined distance from each other are in contact with the image drying roller 120. The heating rollers 121 and 122 heat the image drying roller 120 and vaporizes the liquid carrier absorbed in the surface thereof. The vaporized liquid carrier is collected by an additional collection apparatus (not shown).

In the conventional image forming apparatus 200 having the above structure, the image drying roller 120 performs a rolling movement while contacting the photoreceptor web 110. The image drying roller 120 should rotate adaptively corresponding to the movement of the photoreceptor web 110. If the image drying roller 120 rotates not complying with the movement of the photoreceptor web 110, the image drying roller 120 slips on the photoreceptor web 110. The slippage of the image drying roller 120 results in abrasion of the surface of the photoreceptor web 110, thus damaging the toner image on the photoreceptor web 110.

Damage to the toner image due to slippage of the image drying roller 120 occurs when the liquid carrier absorbed in the surface of the image drying roller 120 is accumulated over a predetermined degree. Particularly, when the image processing is performed for a long time and the amount of vaporization of the liquid carrier by the heating rollers 121 and 122 continuously exceeds that of the liquid carrier absorbed from the photoreceptor web 110, the image drying roller 120 slips on the photoreceptor web 110.

The slippage phenomenon also occurs when the image drying roller 120 continuously absorbs the liquid carrier while contacting the photoreceptor web 110 so that an appropriate temperature is not maintained during the continuous formation of an image. Such a phenomenon occurs at the conventional image forming apparatus so that a desired quality image cannot be obtained.

SUMMARY OF THE INVENTION

To solve the above problem, it is an objective of the present invention to provide a liquid image forming apparatus which can form a quality image, and a method thereof.

Accordingly, to achieve the above objective, there is provided a liquid image forming apparatus including at least a driving roller, a photoreceptor web circulating along an endless path by a backup roller and a steering roller, an image forming portion for forming a toner image on the photoreceptor web with liquid toner including a liquid carrier, an image drying roller for absorbing the liquid carrier remaining on the photoreceptor web while performing a rolling movement in contact with the photoreceptor web, a heating roller for heating the image drying roller, and a transfer roller for pressing the photoreceptor web against the backup roller at a predetermined pressure to transfer the toner image attached to the photoreceptor web to a printing paper. The liquid image forming apparatus includes a rotation speed detection portion provided at one side of the image drying roller for detecting a rotation speed of the image drying roller, a speed comparison portion for determining whether the image drying roller is rotating at normal speed by comparing the rotation speed of the image drying roller detected by the rotation speed detection portion with a predetermined range of a reference rotation speed; and a controlling portion for making the heating roller heat the image drying roller to a reference temperature to vaporize the liquid carrier absorbed by the image drying roller when it is determined from a signal from the speed comparison portion that the image drying roller does not maintain the regular speed.

It is preferable in the present invention that, when the image drying roller is not maintained at the normal speed, the controlling portion makes the image drying roller become separated from the photoreceptor web after a unit toner image presently processed is completely transferred to the printing paper by the transfer roller.

According to another aspect of the above invention, there is provided a method for forming an image by a liquid image forming apparatus including at least a driving roller, a photoreceptor web circulating along an endless path by a backup roller and a steering roller, an image forming portion for forming a toner image on the photoreceptor web with liquid toner including a liquid carrier, an image drying roller for absorbing the liquid carrier remaining on the photoreceptor web while performing a rolling movement in contact with the photoreceptor web, a heating roller for heating the image drying roller, and a transfer roller for pressing the photoreceptor web against the backup roller at a predetermined pressure to transfer the toner image attached to the photoreceptor web to a printing paper. The above method includes the steps of a) making the heating roller heat the image drying roller to a temperature in a preset range, b) forming a unit toner image on the photoreceptor web by the image forming apparatus, c) removing excess liquid toner remaining on the unit toner image by the image drying roller, d) transferring the toner image on the printing paper via the transfer roller, e) detecting the rotation speed of the image drying roller and comparing the detection result with the reference rotation speed in a predetermined range, and f) when the detected rotation speed of the image drying roller is out of the reference rotation speed range, making the heating roller heat the image drying roller to the preset temperature range immediately while performing printing or in a state in which the image drying roller is separated from the photoreceptor web.

It is preferable in the present invention that the step (e) is executed in real time during steps (b) through (d), and that the step (f) is executed after the toner image presently processed is completely transferred.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
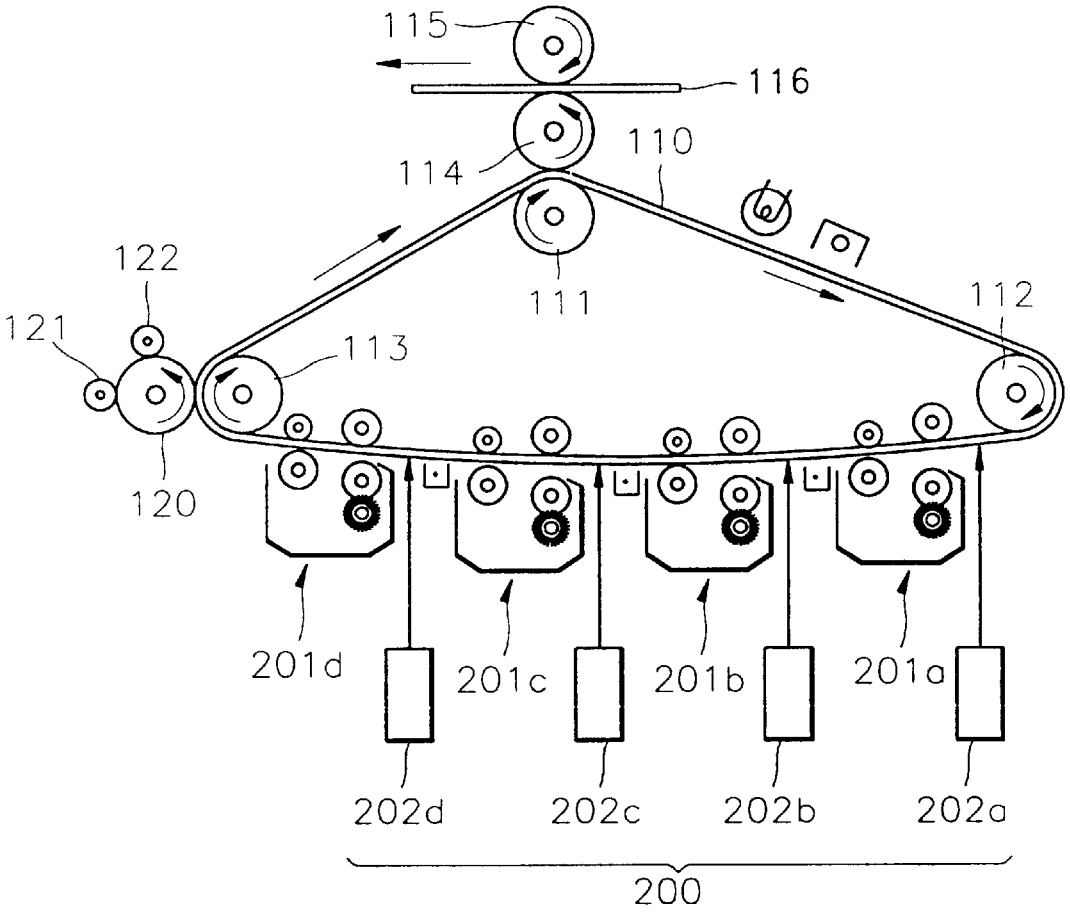
FIG.1 PRIOR ART
FIG. 1 is a view showing the structure of the conventional liquid image forming apparatus.

In the description of a preferred embodiment of the present invention, the same elements as those shown in FIG. 1 have the same reference numerals.

Figure 2:
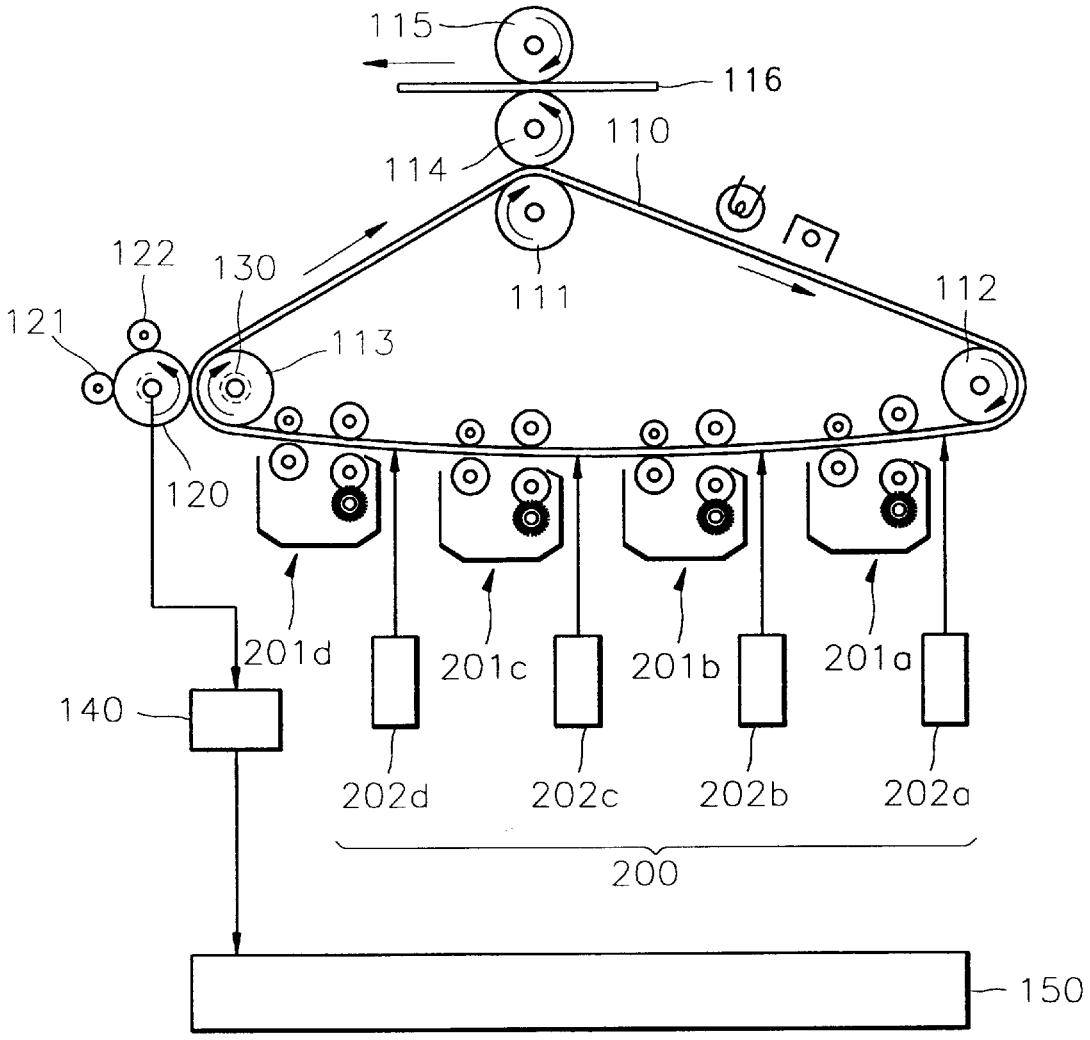
FIG. 2 is a view showing the structure of a liquid image forming apparatus according to the present invention.

Referring to FIG. 2, the photoreceptor web 110 is supported by three rollers 111, 112 and 113. Reference numeral 111 denotes the backup roller which applies a predetermined pressure to the photoreceptor web 110 against the transfer roller 114 installed adjacent thereto so that a toner image on a thin film formed on the photoreceptor web 110 is transferred to the transfer roller 114. Reference numeral 112 denotes the steering roller which prevents the photoreceptor web 110 from circulating obliquely. Reference numeral 113 denotes the driving roller for rotating the photoreceptor web 110 and backing up the pressure to the photoreceptor web 110 which is applied to the image drying roller, which is described later. The press roller 115 contacting the transfer roller 114 at a predetermined pressure is installed at the side of the transfer roller 114. The transfer roller 114 transfers the toner image adhering thereto to the print paper 116 passing between the transfer roller 114 and the press roller 115.

The image forming apparatus 200 for forming a toner image on a surface of the photoreceptor web 110 is disposed along the photoreceptor web 110 running between the steering roller 112 and the driving roller 113. The image forming apparatus 200 includes laser scanning units 202*a*, 202*b*, 202*c* and 202*d* using a laser beam and developing units 201*a*, 201*b*, 201*c* and 201*d*, which are alternately installed. For each color, that is, yellow, magenta, cyan, and black, a laser scanning unit and a developing unit adjacent thereto form a toner image.

The laser scanning units 202*a*, 202*b*, 202*c* and 202*d* emit a laser beam onto the surface of the photoreceptor web 110 according to an image signal per color to form an electrostatic latent image. The developing units 201*a*, 201*b*, 201*c* and 201*d* develops the latent image formed by the laser scanning units 202*a*, 202*b*, 202*c*, and 202*d*, to a toner image. Here, the toner image includes a large amount of liquid carrier.

The developing units 201*a*, 201*b*, 201*c*, and 201*d*, of the image forming apparatus 200 each include a developing roller for coating a developer of a predetermined color on the photoreceptor web 110 and a squeeze roller for removing excess developer coated on the photoreceptor web 110. The squeeze roller squeezes the photoreceptor web 110 to remove a large amount of liquid carrier remaining on the toner image.

The image drying roller 120 for completely removing the liquid carrier remaining on the toner image from the photoreceptor web 110 is provided adjacent to the driving roller 113. The image drying roller 120 contacts the photoreceptor web 110 when the image forming apparatus 200 operates and is separated from the photoreceptor web 110 when the image forming apparatus 200 does not operate; for example, in a standby state or when heating the image drying roller 120 to a temperature within a reference range, which will be described later.

The surface of the image drying roller 120 consists of an outer surface having an affinity for oil for absorbing the liquid carrier from the photoreceptor web 110 and an inner surface disposed under the outer surface and having an anti-oil characteristic for preventing intrusion of the liquid carrier. The image drying roller 120 absorbs the liquid carrier remaining on the surface of the photoreceptor web 110 while being rotated in contact with the photoreceptor web 110. Two heating rollers 121 and 122 separated a predetermined distance from each other, are in contact with the image drying roller 120.

The heating rollers 121 and 122 heat the image drying roller 120 and vaporize the liquid carrier absorbed in the surface thereof. The vaporized liquid carrier is collected by an additional collection apparatus (not shown).

In addition to the above structure, a rotation speed detector 130 for detecting the number of rotations of the image drying roller 120 is provided at the side of the image drying roller 120 installed adjacent to the driving roller 113. Signals from the rotation speed detector 130 are inputted to a speed comparator 140 which determines whether the image drying roller 120 rotates at a constant speed, by comparing the rotation speed of the image drying roller 120 obtained from the rotation speed detector 130 and the reference rotation speed, within a predetermined range. If the speed comparator 140 determines that the image drying roller 120 does not rotate at a constant speed within a predetermined range, the speed comparator 140 sends information about correction of the temperature of the image drying roller 120 to a system controller 150 which controls the entire system. When the information is received, the system controller 150 instantly controls the heating rollers 121 and 122 to heat the image drying roller 120 in a state in which printing continues. After the toner image currently being processed is completely transferred to the printing paper 116, the entire system is restored to its initial state and the image drying roller 120 is heated by the heating rollers 121 and 122 to a temperature within a preset range.

In the case in which the image drying roller 120 is heated in the initial state, that is, being separated from the photoreceptor web 110, the image drying roller 120 is separated from the photoreceptor web 110 and is in contact with the heating roller 121 and 122. The heating rollers 121 and 122 heat the image drying roller 120 while rotating and the image drying roller 120 is rotated accordingly due to friction. The heating rollers 121 and 122 are integrally installed together with the image drying roller 120. When the image drying roller 120 is heated to a temperature within a normal range, the system controller 150 coverts the entire system to a state in which an image can be formed and proceeds to the next image forming step.

Figure 3:
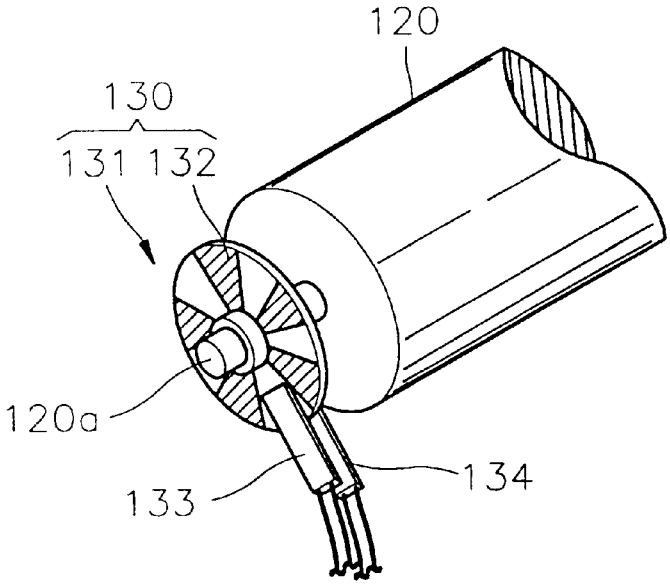
FIG. 3 is a perspective view showing a rotation speed detector of an image drying roller adopted in the liquid image forming apparatus according to the present invention.
Figure 4:
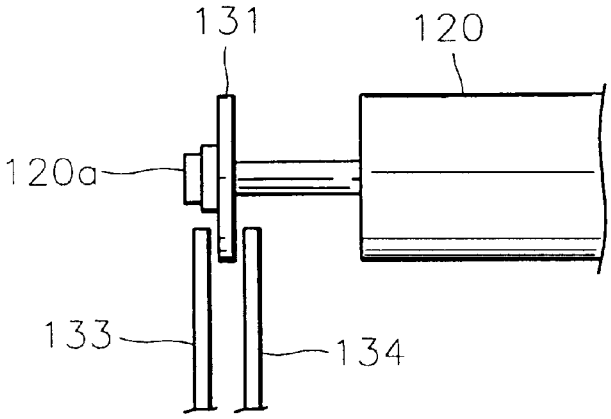
FIG. 4 is a plan view showing the rotation speed detector of an image drying roller adopted in the liquid image forming apparatus according to the present invention.

The rotation speed detector 130 can be represented by a common optical, electromagnetic interrupter apparatus and method. Referring to FIGS. 3 and 4, the rotation speed detector 130 includes a rotor 131 having a light passing region 132 provided at predetermined angular intervals with respect to a rotational shaft 120*a* of the image drying roller 120 and a light emitting portion 133 and a light receiving portion 134 provided to face each other with respect to the rotor 131 inserted therebetween. Alternatively, in the rotation speed detector 130, the light passing region 132 of the rotor 131 can be replaced by a magnetic area generating a magnetic force and the light receiving portion 134 can be replaced by a magnetic coil capable of detecting magnetism without including the light emitting portion 133. The above case is an example of applying an electromagnetic interrupter. Both of the above two cases generate electric pulse signals of a constant period and transmit the signals to the rotation speed comparator 140.

Figure 5:
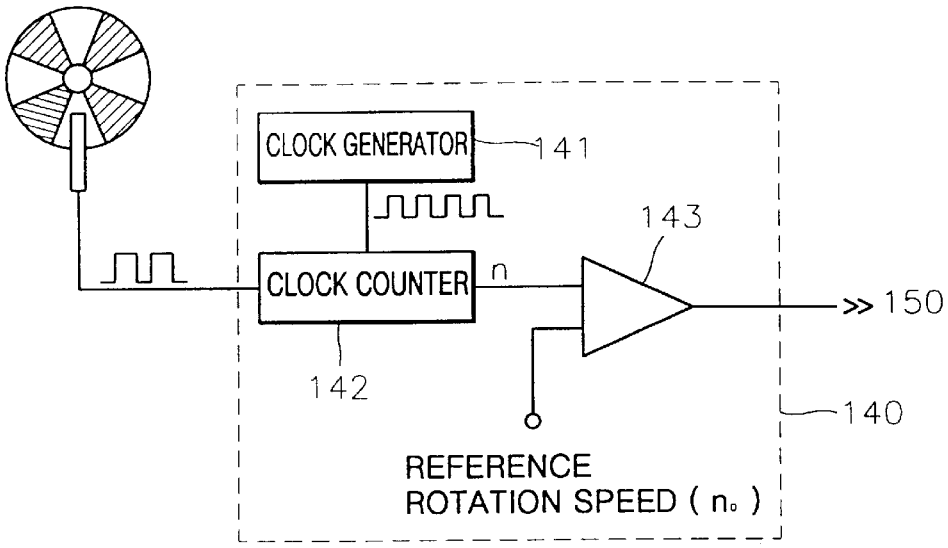
FIG. 5 is a block diagram showing the relationship between the rotation speed detector and a speed comparator shown in FIGS. 3 and 4.

Referring to FIG. 5, the rotation speed comparator 140 receives the pulse signal from the rotation speed detector 130. A clock generator 141 and a pulse counter 142 are provided inside the rotation speed comparator 140 . The pulse counter 142 counts the number of clock signals from the clock generator 131 per period of one pulse signal and obtains the wavelength of the pulse signal from the rotation speed detector 130; that is, the rotation speed n of the image drying roller 120. The comparator 143 compares the obtained rotation speed n with the preset reference speed $n_0$. The result of the above comparison is used to determine whether the rotation speed of the image drying roller 120 is within a reference speed range. Here, if the comparator 143 determines that the rotation speed of the image drying roller 120 is outside of the reference speed, for example to be lower than the reference speed, the image drying roller 120 is determined to absorb excess liquid carrier such that the image drying roller 120 slips on the photoreceptor web 110. Such information is sent to the system controller 150 and the image drying roller 120 is heated to the preset temperature through the above-mentioned process.

Figure 6:
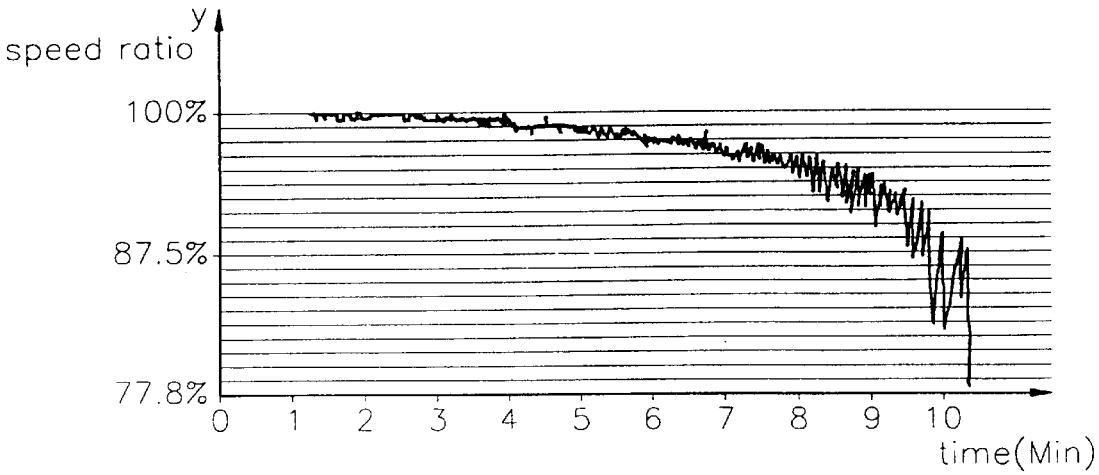
FIG. 6 is a graph indicating the change in the rotation speed of the image drying roller with respect to time.

FIG. 6 is a graph indicating the change in speed of the image drying roller 120 during formation of an image. In FIG. 6, the Y axis indicates the speed ratio of the image drying roller 120 with respect to the reference speed and the X axis indicates the time (minutes).

As shown in FIG. 6, the speed ratio of the image drying roller 120 decreases from the constant speed (100%) as time passes. As shown in the graph, the speed ratio is maintained around 100% for the first three minutes and thereafter sharply drops as the image formation continues.

The phenomenon as shown in FIG. 6 is periodically corrected by measuring the speed of the image drying roller in real time by the present invention, for example, a period of 3 minutes, so that an image having a predetermined quality level can be obtained.

The above-described image forming process by the liquid forming apparatus of the present invention is according to a liquid image forming method of the present invention.

Figure 7:
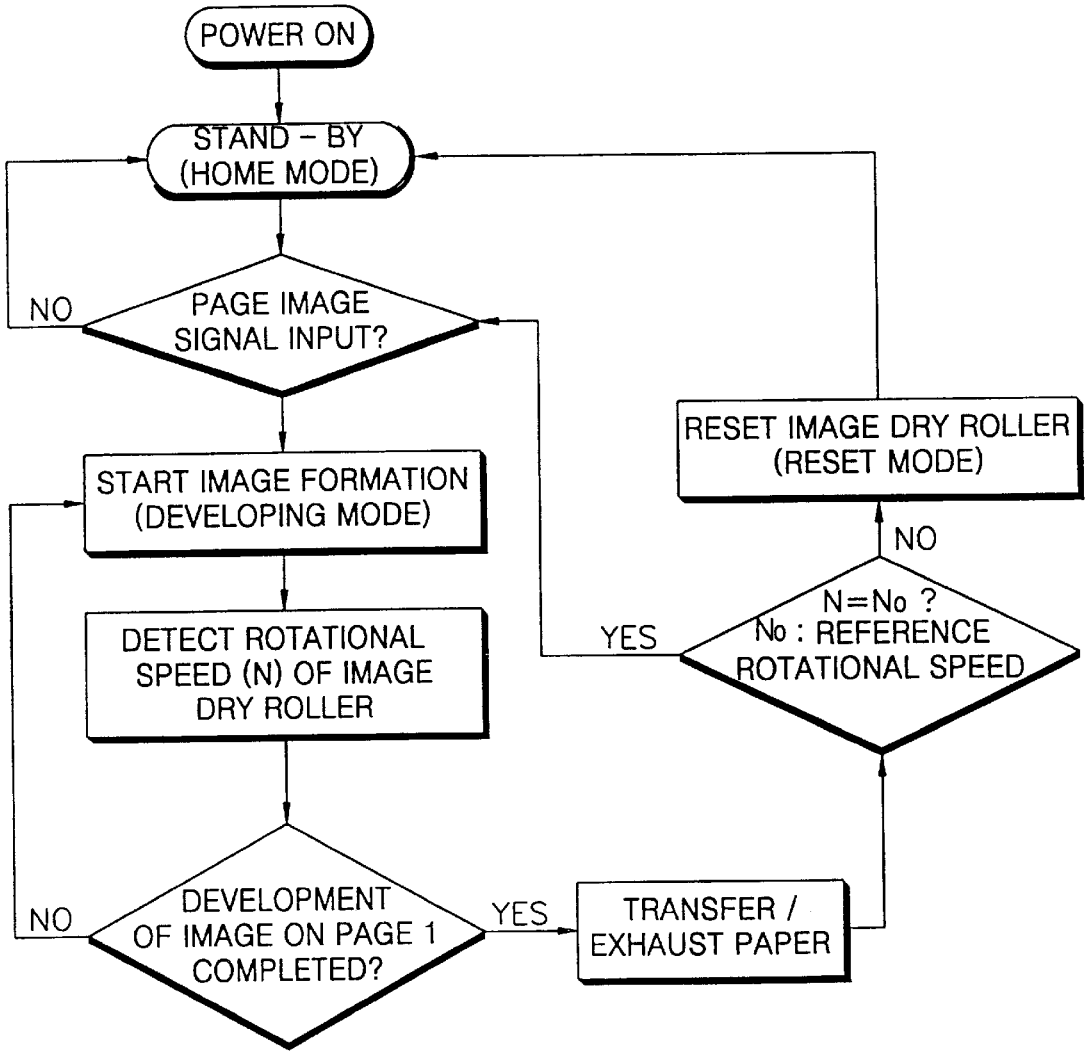
FIG. 7 is a flow chart for explaining a liquid image forming method according to the present invention.

FIG. 7 is a flow chart explaining a preferred embodiment of a liquid image forming method of the present invention in which the image drying roller 120 is reset in the initialization state in which the image drying roller 120 is separated from the photoreceptor web 110 when the image drying roller 120 rotates at an abnormal speed.

The liquid image forming process is divided into three steps: an initialization mode (standby), a developing mode, and a reset mode.

In the initialization mode, or a home mode, when the power is turned on, the entire system is set to a state in which image formation is possible, in which the developing units 201*a*, 201*b*, 201*c*, and 201*d*, and the image drying roller 120 are separated from the photoreceptor web 110. Like other general printers, the initialization mode includes steps of checking the existence of mechanical and electronic errors in the entire system and print papers, and heating members needing preheating, for example, heating the image drying roller 120 to the reference temperature.

In the developing mode, when information on an image is input to the system, the image is formed. The developing mode includes steps of rotating the photoreceptor web 110, forming an electrostatic latent image by the laser scanning units 202*a*, 202*b*, 202*c*, and 202*d*, developing the toner image by the developing units 201*a*, 201*b*, 201*c* and 201*d* approaching the photoreceptor web 110, squeezing the toner image, drying the toner image, and transferring the toner image. Here, the developing units 201*a*, 201*b*, 201*c*, and 201*d*, ascends and approaches the photoreceptor web 110 and the image drying roller 120 contacts the photoreceptor web 110 at an appropriate pressure to be capable of rolling. The image drying roller 120 is continuously heated by the heating rollers 121 and 122.

As the photoreceptor web 110 rotates, an electrostatic latent image is formed on the photoreceptor web 110 by the LSUs 202*a*, 202*b*, 202*c*, and 202*d*, for each color. Next, the developing units 201*a*, 201*b*, 201*c*, and 201*d*, supply liquid toner for each color to the electrostatic latent image formed on the photoreceptor web 110 to form a toner image. The toner image is formed to be a film by squeezing the photoreceptor web 110 where the toner image is formed and excess liquid toner is removed. The portion where the excess liquid toner is removed is dried as it passes the image drying roller 120 and the dried toner image is transferred to the print paper 116 via the transfer roller 114. During the development mode, the rotation speed n of the image drying roller 120 is continuously detected by the above-mentioned elements. The detected speed is determined to be in the range of the reference speed. When the rotation speed of the image drying roller 120 is determined to be normal, the development mode continues to proceed according to the existence of an image signal input. When the rotation speed of the image drying roller 120 is not normal, the toner image presently processed is transferred to the print paper 116 and the reset mode is executed after the print paper 116 is exhausted or concurrently therewith.

The reset mode is executed when the image drying roller 120 does not rotate at the reference speed and the image drying roller 120 slips on the photoreceptor web 110. In the reset mode, the image drying roller 120 is separated from the photoreceptor web 110 and heated by the heating rollers 121 and 122 to the range of the reference temperature. The image drying roller 120 is separated as in the home mode. Here, the developing units 201*a*, 201*b*, 201*c* and 201*d* can be separated from the photoreceptor web 110. Thus, the reset mode can be included in the home mode.

In detail, the method of forming a liquid image of the present invention includes the following steps.

a) making the heating roller heat the image drying roller to a temperature in a preset range;

b) forming a unit toner image on the photoreceptor web by the image forming apparatus;

c) removing excess liquid toner remaining on the unit toner image by the image drying roller;

d) transferring the toner image on the print paper via the transfer roller;

e) detecting the rotation speed of the image drying roller and comparing the detection result with the reference rotation speed in a predetermined range; and f) when the detected rotation speed of the image drying roller is outside of the reference rotation speed range, making the heating roller heat the image drying roller to the preset temperature range immediately while performing printing or in a state in which the image drying roller is separated from the photoreceptor web.

As described above, in the liquid image forming apparatus and method of the present invention, as the image drying roller directly contacting the toner image (which is one factor in determining the quality of the toner image to be transferred to the printing paper) rotates corresponding to the proceeding of the photoreceptor web while appropriately being in contact with the photoreceptor web, damage to the toner image due to slippage by the image drying roller can be prevented.

According to the present invention, the toner image in a damp state, which is vulnerable to damage due to friction before being dried, can be protected. Thus, a quality printed material can be secured. Particularly, the present invention is useful for a printer requesting a long-term and a large amount of image printing. Also, a quality printed material can be produced with consistent quality regardless of the amount of printing.

It is noted that the present invention is not limited to the preferred embodiment described above, and it is apparent that variations and modifications by those skilled in the art can be effected within the spirit and scope of the present invention defined in the appended claims.

What is claimed is:

1. A liquid image forming apparatus including at least a driving roller, a photoreceptor web circulating along an endless path by using a backup roller and a steering roller, an image forming portion which forms a toner image on said photoreceptor web using a liquid toner including a liquid carrier, an image drying roller which absorbs said liquid carrier remaining on said photoreceptor web while performing a rolling movement while in contact with said photoreceptor web, a heating roller which heats said image drying roller, and a transfer roller which presses said photoreceptor web against said backup roller at a predetermined pressure to transfer said toner image attached to said photoreceptor web to a printing paper, said apparatus comprising:

a rotation speed detection portion provided at one side of said image drying roller which detects a rotation speed of said image drying roller;

a speed comparison portion which determines whether said image drying roller is rotating at a predetermined speed by comparing the rotation speed of said image drying roller detected by said rotation speed detection portion with a predetermined range of a reference rotation speed; and a controlling portion which controls said heating roller to heat said image drying roller to a predetermined reference temperature to vaporize the liquid carrier absorbed by said image drying roller when a signal from said speed comparison portion indicates that said image drying roller does not maintain said predetermined speed.

2. The apparatus as claimed in claim 1, wherein, when said image drying roller is not maintained at the predetermined range of reference rotation speed, said controlling portion controls a separation of said image drying roller from said photoreceptor web after a currently processed unit toner image is completely transferred to said printing paper by said transfer roller.

3. The apparatus as claimed in claim 2, wherein said rotation speed detection portion is one of an electrooptic and electromagnetic interrupter apparatus.

4. The apparatus as claimed in claim 1, wherein said rotation speed detection portion is one of an electrooptic and an electromagnetic interrupter apparatus.

5. A method for forming an image by a liquid image forming apparatus including at least a driving roller, a photoreceptor web circulating along an endless path by using a backup roller and a steering roller, an image forming portion which forms a toner image on said photoreceptor web with a liquid toner including a liquid carrier, an image drying roller which absorbs said liquid carrier remaining on said photoreceptor web while performing a rolling movement while in contact with said photoreceptor web, a heating roller which heats said image drying roller, and a transfer roller which presses said photoreceptor web against said backup roller at a predetermined pressure to transfer said toner image attached to said photoreceptor web to a printing paper, said method comprising the steps of:

a) heating said heating roller to heat said image drying roller to a temperature in a preset range;

b) forming a unit toner image on said photoreceptor web by said image forming apparatus;

c) removing excess liquid toner remaining on said unit toner image by said image drying roller;

d) transferring said toner image on said printing paper via said transfer roller;

e) detecting a rotation speed of said image drying roller and comparing a detection result with a reference rotation speed in a predetermined range; and f) wherein when the detected rotation speed of said image drying roller is outside of a reference rotation speed range, heating said image drying roller to the preset temperature range either one of immediately while performing printing and in a state in which said image drying roller is separated from said photoreceptor web.

6. The method as claimed in claim 5, wherein said step (e) is executed in real time during steps (b) through (d).

7. The method as claimed in claim 6, wherein said step (f) is executed after said toner image currently being processed is completely transferred.

8. The method as claimed in claim 5, wherein said step (f) is executed after said currently processed toner image is completely transferred.

9. A liquid image forming apparatus including at least a driving roller, a photoreceptor web circulating along an endless path by using a backup roller and a steering roller, means for forming an image which forms a toner image on said photoreceptor web using a liquid toner including a liquid carrier, means for drying said photoreceptor web which absorbs said liquid carrier remaining on said photoreceptor web while performing a rolling movement while in contact with said photoreceptor web, means for heating an image drying roller, and means for pressing said photoreceptor web against said backup roller at a predetermined pressure to transfer said toner image attached to said photoreceptor web to a printing paper, said apparatus comprising:

means for detecting a rotation speed of said drying means, said rotation speed detection means being provided at one side of said drying means;

means for comparing a speed of said drying means to determine if said drying means is rotating at a predetermined speed by comparing the rotation speed of said drying means detected by said rotation speed detection means with a predetermined range of a reference rotation speed; and means for controlling said heating means to heat said drying means to a predetermined reference temperature to vaporize the liquid carrier absorbed by said drying means when a signal from said speed comparing means indicates that said drying means does not maintain said predetermined range of said reference rotation speed.

* * * * *